US008016284B2

(12) United States Patent
Tanaka et al.

(10) Patent No.: US 8,016,284 B2
(45) Date of Patent: Sep. 13, 2011

(54) SHEET FEEDING DEVICE AND DOCUMENT READING DEVICE

(75) Inventors: Kenji Tanaka, Osaka (JP); Hideyuki Hiro, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 35 days.

(21) Appl. No.: 12/542,788

(22) Filed: Aug. 18, 2009

(65) Prior Publication Data

US 2010/0052249 A1 Mar. 4, 2010

(30) Foreign Application Priority Data

Sep. 2, 2008 (JP) ..... 2008-224556

(51) Int. Cl.
*B65H 3/06* (2006.01)

(52) U.S. Cl. ..... 271/118; 271/117; 271/115

(58) Field of Classification Search ..... 271/110, 271/117, 118, 114, 115
See application file for complete search history.

(56) References Cited

U.S. PATENT DOCUMENTS

| | | | | |
|---|---|---|---|---|
| 5,344,134 | A * | 9/1994 | Saeki et al. | 271/122 |
| 5,715,071 | A * | 2/1998 | Takashimizu et al. | 358/498 |
| 6,000,690 | A * | 12/1999 | Kudoh | 271/117 |
| 6,089,563 | A * | 7/2000 | Takashimizu et al. | 271/117 |
| 2003/0085506 | A1 * | 5/2003 | Kubo | 271/117 |
| 2005/0023745 | A1 * | 2/2005 | Morimoto et al. | 271/117 |
| 2005/0073087 | A1 * | 4/2005 | Kadowaki et al. | 271/118 |
| 2010/0059929 | A1 * | 3/2010 | Okumura | 271/117 |
| 2010/0078874 | A1 * | 4/2010 | Nagata | 271/110 |

FOREIGN PATENT DOCUMENTS

| | | |
|---|---|---|
| JP | 2002-002972 | 1/2002 |
| JP | 2002-220123 | 8/2002 |

* cited by examiner

*Primary Examiner* — Kaitlin Joerger
*Assistant Examiner* — Prasad Gokhale
(74) *Attorney, Agent, or Firm* — Renner, Otto, Boisselle & Sklar, LLP

(57) ABSTRACT

An operation of a pickup roller to be performed upon powering on or after paper jam elimination is adjusted according the presence or absence of a document on a document sheet support. When the document is absent on the sheet support, the pickup roller is moved down sufficiently and then moved up by a first distance to assume an upper limit position. When the document is present on the sheet support, the pickup roller is moved up by a second distance which is shorter than the first distance.

9 Claims, 5 Drawing Sheets

SHEET FEEDING DEVICE AND DOCUMENT READING DEVICE

CROSS REFERENCE

This Nonprovisional application claims priority under 35 U.S.C. §119(a) on Patent Application No. 2008-224556 filed in Japan on Sep. 2, 2008, the entire contents of which are hereby incorporated by reference.

BACKGROUND OF THE INVENTION

The present invention relates to a sheet feeding device configured to feed sheets, such as document sheets, one by one to a processing section such as an image forming section, as well as a document reading device configured to read an image carried on a document sheet fed by the sheet feeding device. One known image reading device for reading a document image at an image reading section is provided with a sheet feeding device for feeding document sheets one by one to the image reading section. Such a sheet feeding device includes: a sheet support capable of placing plural document sheets thereon; a pickup roller which can move up and down relative to an upper surface of the sheet support; and a separating roller disposed downstream of the pickup roller in a sheet feed direction, as disclosed in Japanese Patent Laid-Open Publication No. HEI 06-215889.

During standby for sheet feeding, the pickup roller moves up to an upper limit position to allow document sheets to be placed on the sheet support. During sheet feeding, the pickup roller moves down to contact the uppermost surface of the document sheets placed on the sheet support and then rotates. The separating roller separates the uppermost one of document sheets picked up by the pickup roller from the rest in order to feed only the uppermost one of the document sheets toward the image reading section.

In usual cases the sheet support receives document sheets thereon after the sheet feeding device has been powered on. In some cases, however, such document sheets are placed on the sheet support again after a paper jam has been eliminated. For this reason, conventional sheet feeding devices are generally configured to move the pickup roller up to the upper limit position during an initial operation performed just after powering on or just after elimination of the paper jam.

It is possible that document sheets to be fed remain on the sheet support at the time of the occurrence of the paper jam. Therefore, the vertical position of the pickup roller in contact with the upper surface of the uppermost document sheet differs depending upon the number of document sheets placed on the sheet support. Accordingly, the distance to be traveled by the pickup roller up to the uppermost position at the time just after the paper jam elimination varies in accordance with the number of document sheets to be fed that remain on the sheet support. If the distance of travel of the pickup roller in moving up the pickup roller is fixedly set to the distance from the upper surface of the sheet support to the upper limit position, the pickup roller collides with other members including an outer cover during its upward movement just after the paper jam elimination to generate an unusual sound when a large number of document sheets remain on the sheet support. In order to obviate such an inconvenience, the sheet feeding device has to be provided with means for detecting the position of the pickup roller. The provision of such means incurs increases in cost and in device size.

A feature of the present invention is to provide a sheet feeding device which is capable of preventing the pickup roller from colliding with other members without the need to provide the means for detecting the position of the pickup roller, as well as a document reading device provided with such a sheet feeding device.

SUMMARY OF THE INVENTION

A sheet feeding device according to the present invention includes a sheet support, detection means, a pickup roller, a driving mechanism, and a control section. The sheet support is configured to place a sheet thereon. The detection means is configured to detect presence or absence of the sheet on the sheet support. The pickup roller is supported for vertical movement between a lower limit position at which the pickup roller is brought into contact with an upper surface of the sheet support and an upper limit position spaced apart from the upper surface of the sheet support by a first distance and is configured to feed the sheet from the sheet support by rotation. The driving mechanism is configured to cause the pickup roller to move vertically. The control section is configured to perform a first control for causing the pickup roller to move down to the lower limit position and then move up to the upper limit position by means of the driving mechanism during an initial operation to be performed after powering on or after paper jam elimination when the sheet is not detected by the detection means, and a second control for causing the pickup roller to move up by a distance shorter than a predetermined distance when the sheet is detected by the detection means.

The foregoing and other features and attendant advantages of the present invention will become more apparent from the reading of the following detailed description of the invention in conjunction with the accompanying drawings.

DETAILED DESCRIPTION OF THE INVENTION

Hereinafter, a sheet feeding device and a document reading device according to the best mode for carrying out the present invention will be described in detail with reference to the attached drawings.

Figure 1:
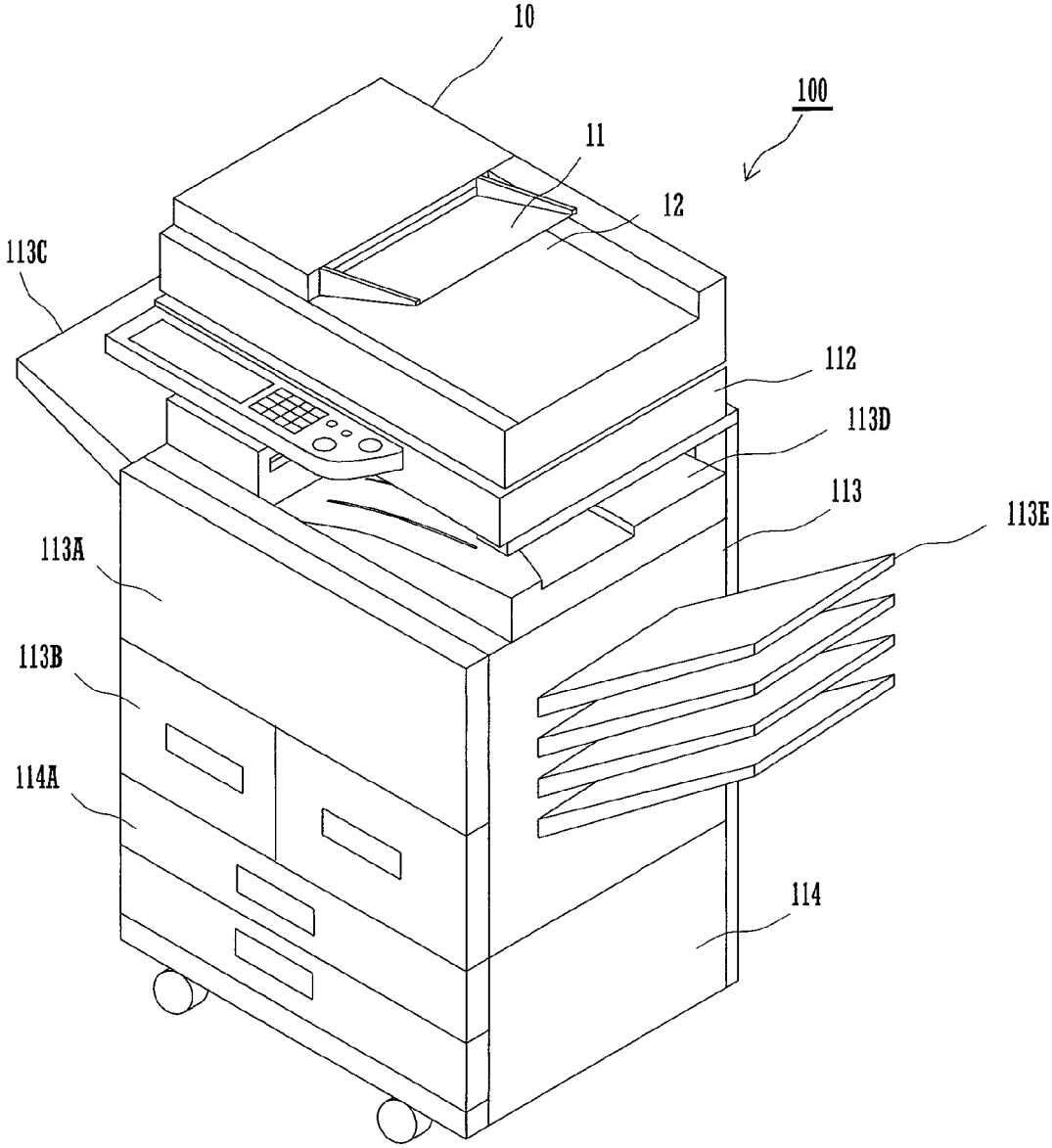
FIG. 1 is a view showing an outward appearance of an image forming apparatus including a document reading device provided with a sheet feeding device according to an embodiment of the present invention.

As shown in FIG. 1, an image forming apparatus 100 including a document reading device provided with a sheet feeding device according to an embodiment of the present invention can be operated in any one of a copy mode, a facsimile mode, a scanner mode and a printer mode selectively. In the copy mode, the image forming apparatus 100 prints an image read from a document on a recording sheet. In the facsimile mode, the image forming apparatus 100 transmits an image read from a document through a public communication line while printing an image received through the public communication line on a recording sheet. In the scanner mode, the image forming apparatus 100 outputs an image read from a document to an external information terminal device. In the printer mode, the image forming apparatus 100 prints an image inputted thereto from an information terminal device via a network.

The image forming apparatus 100 includes a scanner unit 112, an image forming unit 113, and a sheet feeding unit 114.

The scanner unit 112, which is equivalent to the document reading device defined by the present invention, includes an image reading section therein and is fitted with a sheet feeding device 10 on an upper surface thereof. The sheet feeding device 10 includes a sheet support 11 and a delivered sheet rest 12 and defines a document feed path extending from the sheet support 11 to the delivered sheet rest 12 via the image reading section. In any one of the copy mode, facsimile mode and scanner mode, a document placed on the sheet support is fed into the document feed path. The scanner unit 112 reads an image carried on the document at the image reading section.

The image forming unit 113 includes an image forming section 113A, a sheet feed cassette 113B, a manual feed tray 113C, a catch tray 113D, and a sorter 113E. The sheet feed unit 114 includes a sheet feed cassette 114A. The image forming unit 113 forms an image on a recording sheet fed from any one of the sheet feed cassette 113B, manual feed tray 113C and sheet feed cassette 114A at the image forming section 113A and then delivers the recording sheet onto the catch tray 113D or the sorter 113E.

Figure 2:
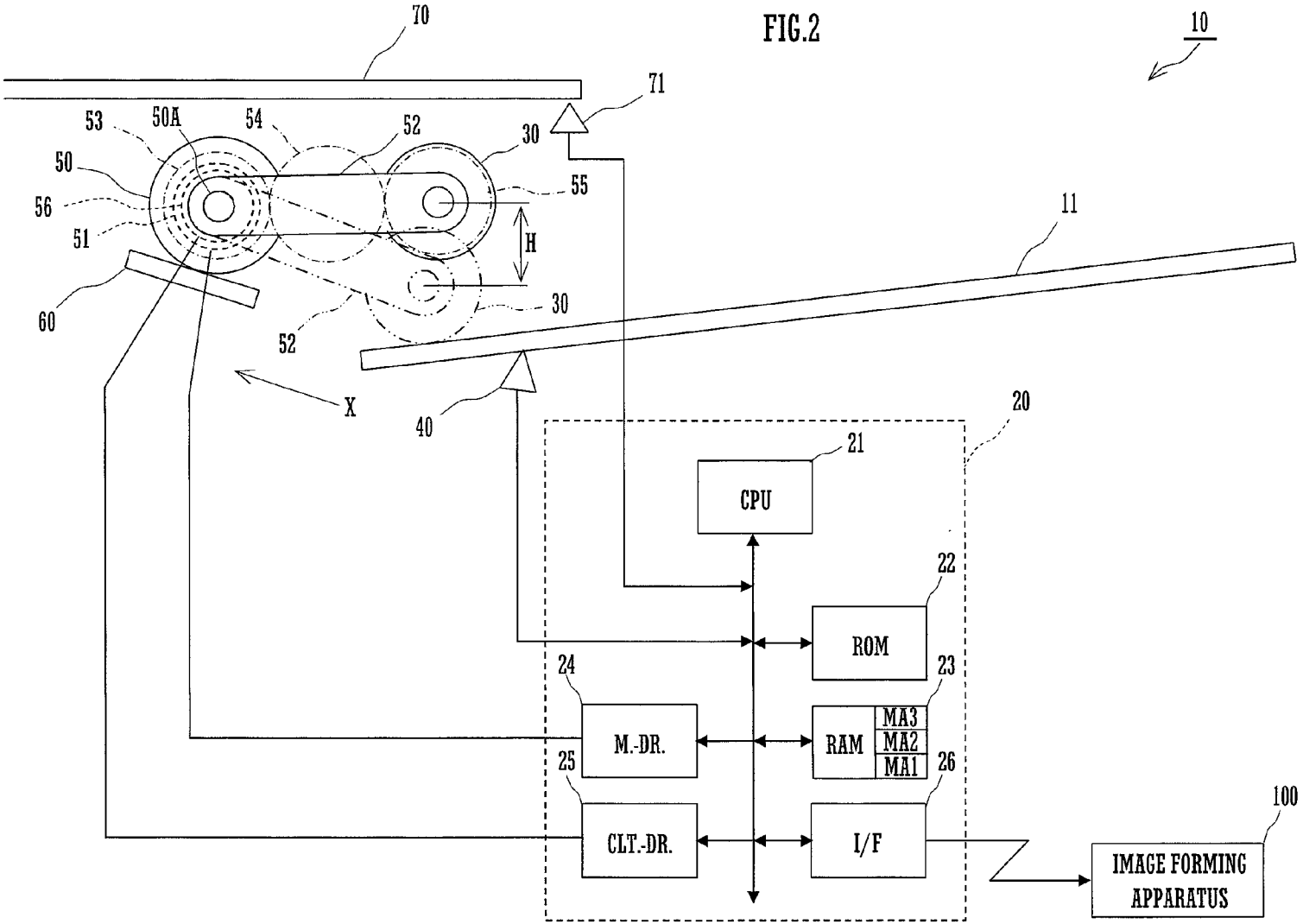
FIG. 2 is a view schematically showing the sheet feeding device according to the embodiment of the present invention.

As shown in FIG. 2, the sheet feeding device 10 includes the sheet support 11, a control section 20, a pickup roller 30, a sensor 40, a separating roller 50, a motor 51, an arm 52, a driving gear 53, a transmission gear 54, a driven gear 55, a friction plate 60, and a cover 70.

The sheet support 11 has an upper surface for placing a document in the form of sheet(s) thereon. Such document sheets on the sheet support 11 are paid out in a direction of arrow X. Each of the document sheets thus paid out from the sheet support 11 is fed into the non-illustrated document feed path.

The pickup roller 30 is rotatably supported at one end of the arm 52, while the arm 52 rotatably supported at its opposite end by a rotating shaft 50A of the separating roller 50. Thus, the pickup roller 30 can swing about the rotating shaft 50A together with the arm 52. The pickup roller 30 is vertically movable between a lower limit position at which the pickup roller 30 is brought into contact with the upper surface of the sheet support 11 as depicted by the dashed double-dotted line of FIG. 2 and an upper limit position which is spaced apart from the upper surface of the sheet support 11 by a first distance H1 as depicted by the solid line of FIG. 2. The pickup roller 30 is configured to rotate clockwise in FIG. 2 to feed the document sheets from the sheet support 11.

The separating roller 50 is rotatably disposed with its peripheral surface partially contacting the friction plate 60. The rotating shaft 50A of the separating roller 50 is coaxially fixed to the rotating shaft of the motor 51. The separating roller 50 is configured to rotate clockwise in FIG. 2 to cause only the uppermost one of the document sheets paid out by the pickup roller 30 to pass between the separating roller 50 and the friction plate 60.

The motor 51 can be driven forwardly and backwardly. The rotating shaft of the motor 51 is fitted with the driving gear 53. Rotation of the rotating shaft of the motor 51 is transmitted to the driven gear 55 fixed to a rotating shaft 30A of the pickup roller 30 via the driving gear 53 and the transmission gear 54. Rotation of the rotating shaft of the motor 51 is also transmitted to the arm 52 via a clutch 56. The transmission gear 54 is rotatably supported on the arm 52.

As the motor 51 rotates forwardly, the arm 52 rotates clockwise in the Figure to move down the pickup roller 30, while the pickup roller 30 rotates clockwise in the Figure. As the motor 51 rotates backwardly, the arm 52 rotates counterclockwise in the Figure to move up the pickup roller 30, while the pickup roller 30 rotates counterclockwise in the Figure. The arm 52 can be rotated within a maximum amount of rotation which is equivalent to the distance H1 of travel of the pickup roller 30 by a selective operation of the clutch 56. In a state in which the motor 51 is not driven, the position of the arm 52 is maintained by a non-illustrated latch mechanism.

The driving mechanism defined by the present invention comprises the motor 51, arm 52, driving gear 53, transmission gear 54, driven gear 55, and clutch 56.

The sensor 40, which is equivalent to the detection means defined by the present invention, is configured to detect the presence or absence of a document at an end portion of the sheet support 11 which lies on the downstream side in the direction of arrow X.

The cover 70 openably covers a portion of the upper surface of the sheet support 11 which lies on the downstream side in the direction of arrow X, as well as the pickup roller 30 and the separating roller 50. A sensor 71 detects whether the cover 70 is open or closed. When a document paper jam occurs in the document feed path, the cover 70 is opened to expose the document feed path.

The control section 20 is formed by connecting a motor driver 24, clutch driver 25, sensors 40 and 71 and interface 26 to a CPU 21 including ROM 22 and RAM 23. The CPU 21 supplies the motor driver 24 and clutch driver 25 with driving data based on detection signals from the sensors 40 and 71 and the like in accordance with a program previously stored in the ROM 22.

At that time, the CPU 21 references flags F1 and F2 and a timer T1 allocated to memory areas MA1 to MA3 of the RAM 23. The flag F1 stores information about whether or not a first control has been performed after powering on or after paper jam elimination. The first control is a control operation for causing an initial operation to be performed which includes moving the pickup roller 30 down to the lower limit position once and then moving up the pickup roller 30 by the distance H1. The flag F2, which is equivalent to storage means defined by the present invention, is configured to store information about whether or not the motor 51 has been driven to move the pickup roller 30 up to the upper limit position by a second control defined by the present invention. The timer T1 is actuated upon removal of the document from the sheet support 11 to clock a predetermined time period.

The motor driver 24 and the clutch driver 25 drive the motor 51 and the clutch 56, respectively, based on the driving data.

The CPU 21 outputs data to and inputs data from a control section of the image forming apparatus 100 via the interface 26. When the scanner unit 112 of the image forming apparatus 100 reads an image carried on the document, the control section of the image forming apparatus 100 outputs a sheet feed request to the CPU 21. In cases where the scanner unit 112 has a control section, the control section of the scanner unit 112 which is configured to output the sheet feed request is connected to the CPU 21.

When the motor 51 rotates forwardly, the driving mechanism causes the pickup roller 30 to move down toward the upper surface of the sheet support 11 while rotating in a direction such as to feed the document sheets. When the motor 51 rotates backwardly, the driving mechanism causes the pickup roller 30 to move up in a direction away from the upper surface of the sheet support 11. The arrangement of the driving mechanism and the controls performed by the control section 20 can be simplified.

Figure 3:
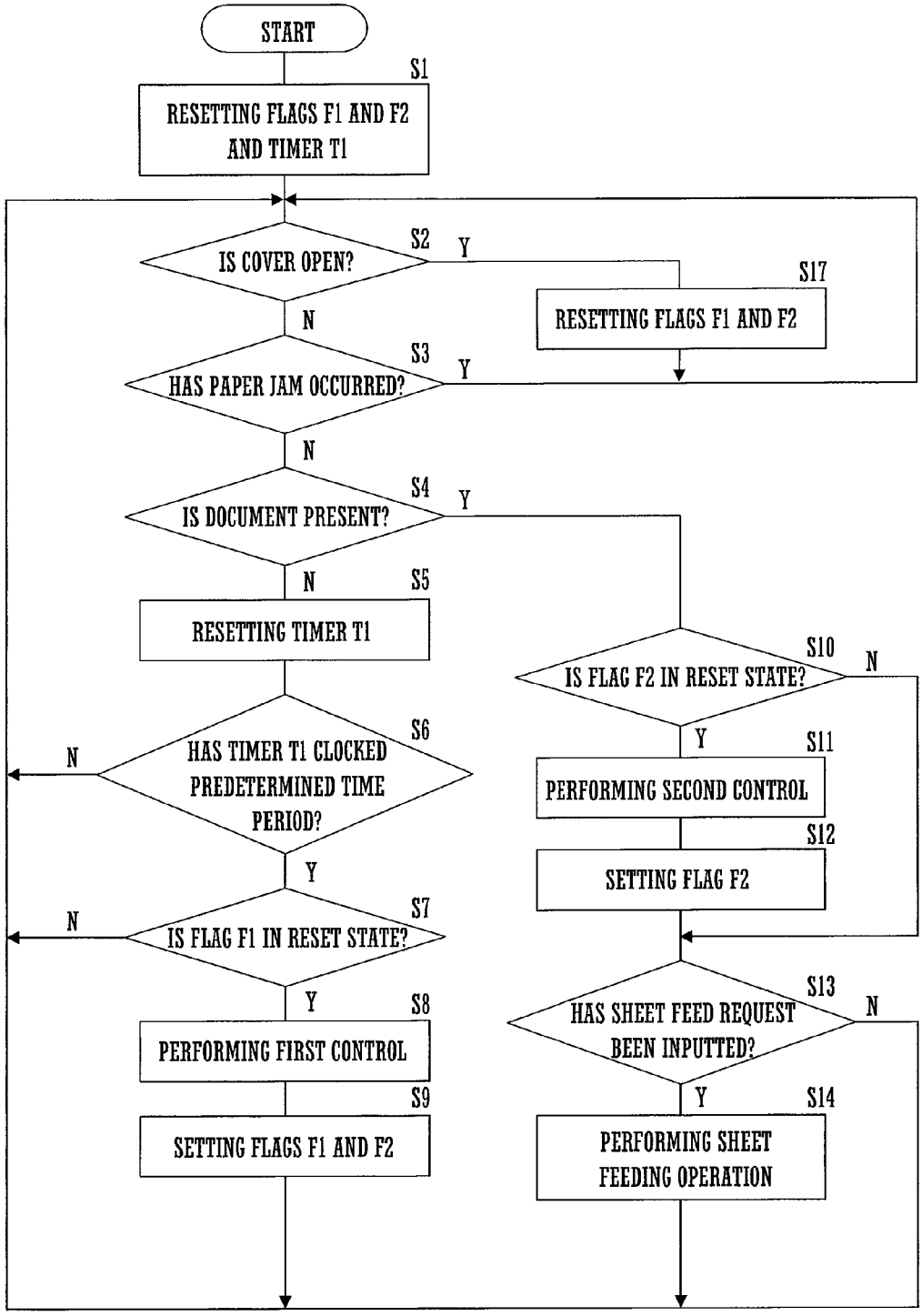
FIG. 3 is a flowchart illustrating process steps performed by a control section of the sheet feeding device.

As shown in FIG. 3, when the sheet feeding device 10 is powered on, the CPU 21 of the control section 20 resets the flags F1 and F2 and the timer T1 in the RAM 23 (step S1) and determines whether or not the cover 70 is open (step S2).

If it is determined that the cover 70 is closed, the CPU 21 determines whether or not the document paper jam has occurred (step S3). If it is determined that the paper jam has not occurred, the CPU 21 determines whether or not a document is placed on the sheet support 11 (step S4). If it is determined that the document is not placed on the sheet support 11, the CPU 21 causes the timer T1 to start clocking the predetermined time period (step S5).

When the timer T1 has clocked the predetermined time period with the cover 70 remaining closed and without the document placed on the document sheet 11 (step S6), the CPU 21 determines whether or not the flag F1 is in a reset state (step S7).

If it is determined that the flag F1 is in the reset state and, hence, the pickup roller 30 is not at the upper limit position, the CPU 21 performs the first control for causing the pickup roller 30 to perform the initial operation (step S8). For this purpose, the CPU 21 supplies the motor driver 24 with driving data to cause the motor 51 to rotate forwardly by a predetermined amount and then rotate backwardly by a predetermined amount.

Figure 4A:
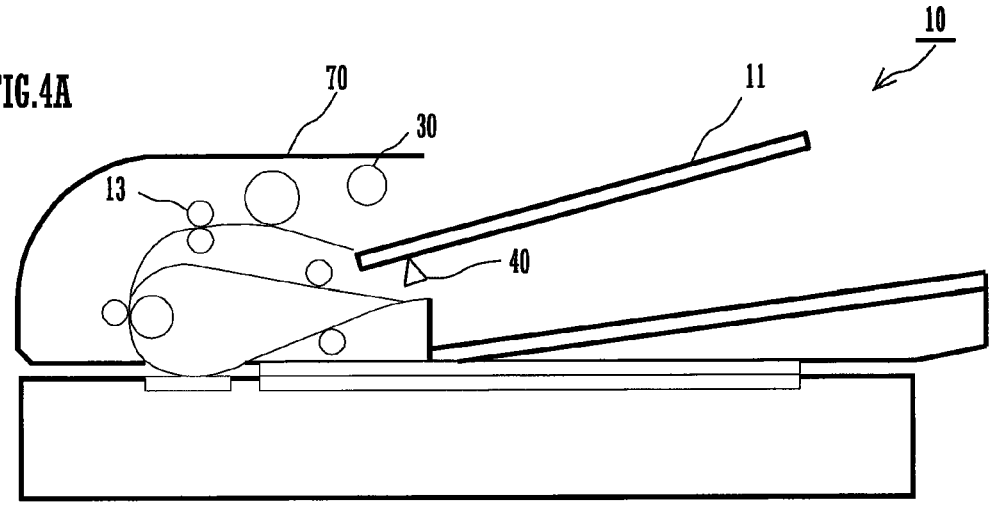
FIGS. 4(A) to 4(C) are each a sectional side elevational view showing an operating state of the sheet feeding device on which any document is not placed thereon.
Figure 4B:
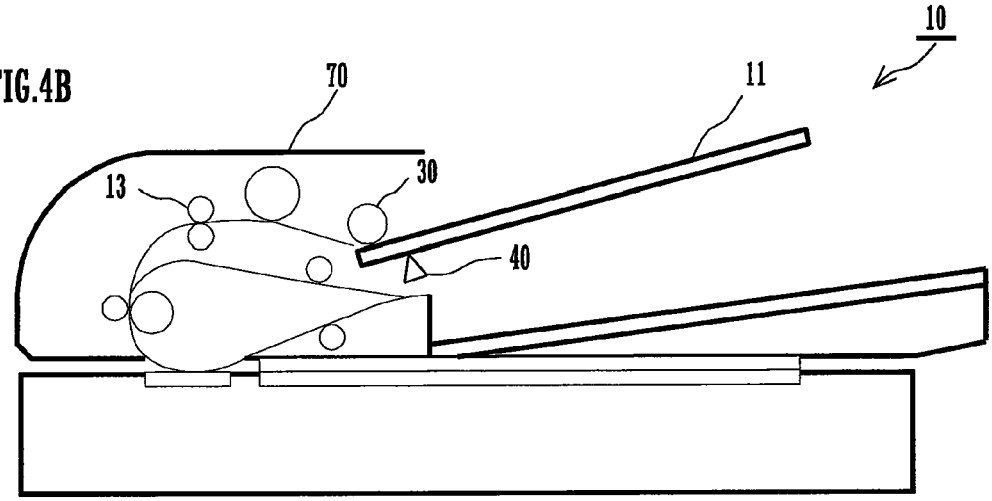
Figure 4C:
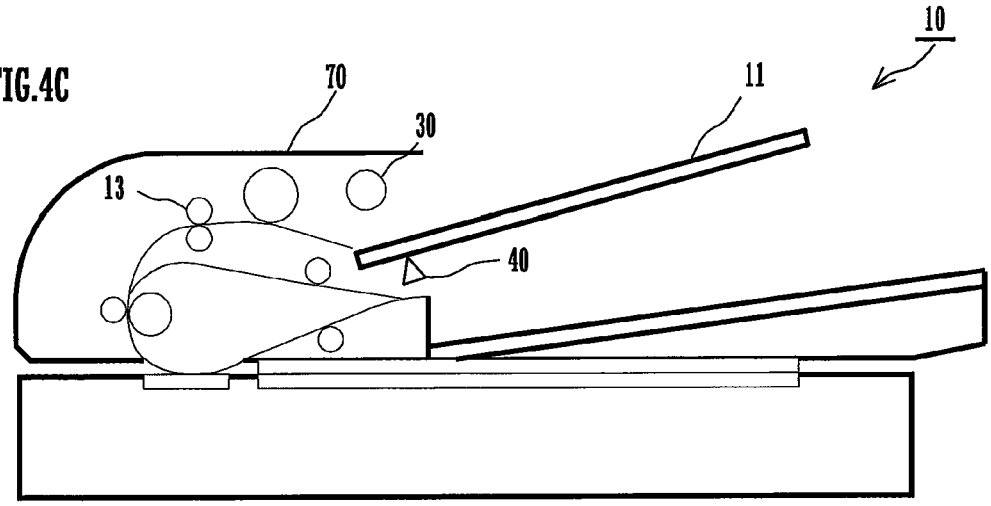

When the condition in which the document is absent on the sheet support 11 has continued for the predetermined time period, the CPU 21 causes the pickup roller 30 to perform the initial operation by performing the process steps S2 to S8. As shown in FIGS. 4(A) to 4(C), the CPU 21 causes the pickup roller 30 to stop at the upper limit position after having moved the pickup roller 30 down to the lower limit position once and then waits for the document to be placed on the sheet support 11. After the initial operation has been completed, the CPU 21 sets the flags F1 and F2 (step S9).

If the sensor 40 detects the document placed on the sheet support 1 in step S4, the CPU 21 determines the status of the flag F2 (step S10). If it is determined that the flag F2 has been set and the pickup roller 30 is at the upper limit position, the CPU 21 determines whether or not the sheet feed request has been inputted (step S13).

If it is determined that the flag F2 has been reset, the CPU 21 sets the flag F2 after having performed the second control (step S12). Specifically, if the pickup roller 30 is not at the upper limit position after paper jam elimination has been completed, the CPU 21 causes the pickup roller 30 to move up by a distance H2.

Figure 5A:
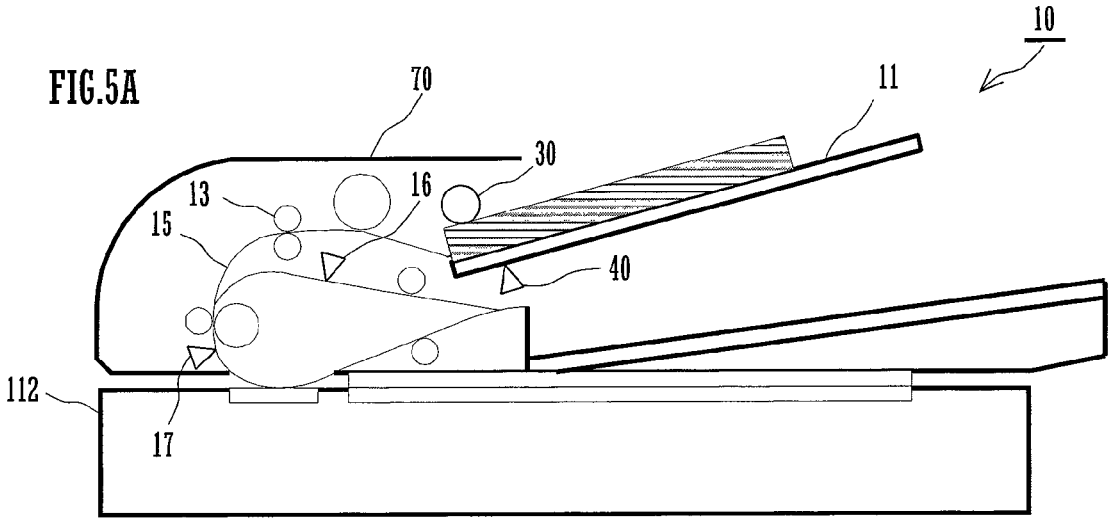
FIGS. 5(A) and 5(B) are each a sectional side elevational view showing an operating state of the sheet feeding device on which a document is placed thereon.
Figure 5B:
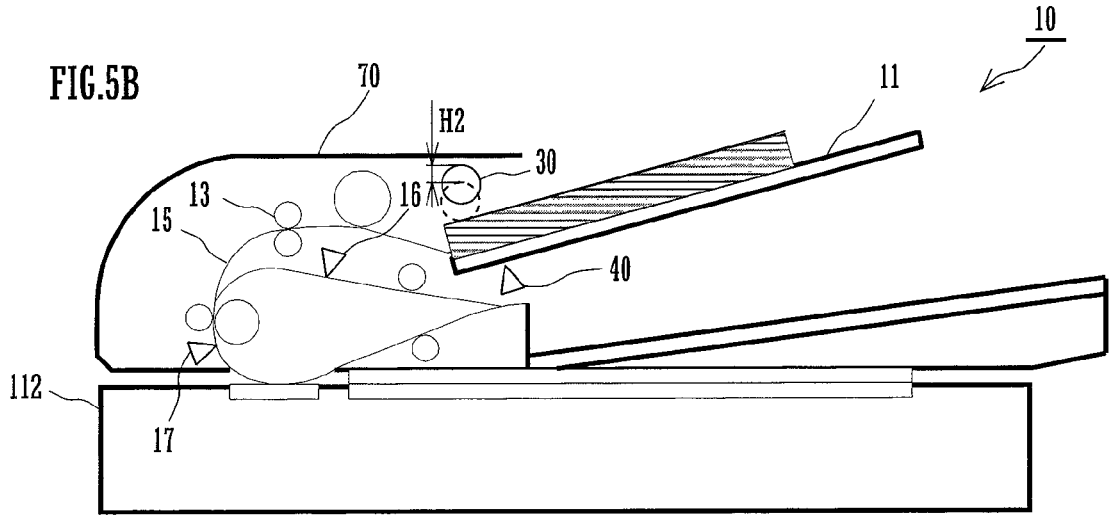

If the document is present on the sheet support 11, the CPU 21 causes the motor 51 to rotate backwardly so as to move up the pickup roller 30 by the distance H2 as shown in FIGS. 5(A) and 5(B) by performing the process steps S2 to S4 and S10 to S12. By so doing, the document can be removed from and placed on the sheet support 11 easily. While repeating the process steps S2 to S4 and S10 to S12, the CPU 21 waits for the sheet feed request to be inputted (step S13).

In response to inputting of the sheet feed request, the CPU 21 causes the motor 51 to rotate forwardly in order to perform a sheet feeding operation (step S14). With the forward rotation of the motor 51, the pickup roller 30 rotates while moving down to contact the upper surface of the uppermost document sheet of the document placed on the sheet support 11. Thus, the uppermost document sheet is paid out in the direction of arrow X. The CPU 21 continues to drive the motor 51 forwardly until at the earliest the leading edge of the document sheet reaches a feed roller 13 provided on the document feed path 15 at a location downstream of the separating roller 50 in the direction of arrow X. When the sheet feeding operation has been completed, the CPU 21 resets the flags F1 and F2 and then returns the process to step S2 (step S15).

With the sheet feed request for the document placed on the sheet support 11 being alive, the CPU 21 repeats the process steps S2 to S4 and S13 to S15 to feed a required number of document sheets to be processed by the image forming apparatus 100.

If the paper jam occurs during the document sheet feeding operation, the CPU 21 stops driving the motor 51. The occurrence of the paper jam is detected based on detection signals from the sensors 16 and 17 disposed on the document feed path 15. The cover 70 is opened to allow a paper jam eliminating operation to be achieved.

When the sensor 71 detects the cover 70 in the open position, the CPU 21 resets the flags F1 and F2 (step S16) and then waits for the closing of the cover 70 and the completion of the paper jam eliminating operation (steps S2 and S3).

In response to the closing of the cover 70 after the completion of the paper jam eliminating operation, the CPU causes the pickup roller 30 to move vertically according to the presence or absence of the document on the sheet support 11. If the document is absent on the sheet support 11, the CPU 21 causes the pickup roller 30 to move up and down. If the document is present on the sheet support 11, the CPU 21 causes the pickup roller 30 to move up by the distance H2.

The distance H2 is a sufficiently smaller value than the distance H1. For example, the distance H2 is a value that is not more than the distance between the position of the upper surface of the uppermost one of document sheets on the sheet support 11 which is assumed when the number of the document sheets is a maximum number of document sheets which can be placed on the sheet support 11 and the lowermost point on the periphery of the pickup roller 30 assuming the uppermost position.

As described above, the vertical movement of the pickup roller 30 is adjusted according the presence or absence of the document on the sheet support 11 during the initial operation to be performed after powering on or after paper jam elimination. When the document is absent on the sheet support 11 at the time of the initial operation, the CPU 21 performs the first control for causing the pickup roller 30 to move down to the lower limit position once and then move up by the first distance H1 to assume the upper limit position. When the document is present on the sheet support 11 at the time of the initial operation, the CPU 21 performs the second control for causing the pickup roller 30 to move up by the second distance H2, which is shorter than the first distance H1.

Even when the pickup roller 30 is at a relatively high position, the operation of placing document sheets on the sheet support 11 or loading additional document sheets on the sheet support 11 can be achieved easily without collision of the pickup roller 30 with other members including the cover 30. Further, since there is no need to provide means for detecting the position of the pickup roller 30, it is possible to reduce the size of the device and the cost.

Since the CPU 21 performs the second control at the time of the initial operation on condition that the document is detected by the sensor 40 while information indicating that the pickup roller 30 is not at the upper limit position is stored in the storage means, the pickup roller 30 can be more reliably prevented from colliding with other members.

When the document placed on the sheet support 11 is removed therefrom, the CPU 21 does not cause the pickup roller 30 to move vertically until the predetermined time period clocked by the timer T1 has elapsed. Thus, while the operator aligns plural document sheets once placed on the sheet support 11 with one another by removing the document sheets from and placing them on the sheet support 11, the pickup roller 30 fails to move down to the lower limit position, thus allowing the placement of the document sheets on the sheet support 11 to be achieved reliably.

While the illustrative embodiment described above has been directed to the sheet feeding device 10 configured to feed document sheets to the scanner unit 112 of the image forming apparatus 100, the present invention is also applicable to a sheet feeding device configured to feed sheets of other types such as recording sheets. The sheet feeding device 10 may be provided integrally with the scanner unit 112.

The foregoing embodiment is illustrative in all points and should not be construed to limit the present invention. The scope of the present invention is defined not by the foregoing embodiment but by the following claims. Further, the scope of the present invention is intended to include all modifications within the scopes of the claims and within the meanings and scopes of equivalents.

What is claimed is:

1. A sheet feeding device comprising:

a sheet support configured to place a sheet thereon;

detection means configured to detect presence or absence of the sheet on the sheet support;

a pickup roller supported for vertical movement between a lower limit position at which the pickup roller is brought into contact with an upper surface of the sheet support and an upper limit position spaced apart from the upper surface of the sheet support by a first distance and configured to feed the sheet from the sheet support by rotation;

a driving mechanism configured to cause the pickup roller to move vertically; and a control section configured to perform a first control when the sheet is not detected by the detection means, the first control for causing the pickup roller to move down to the lower limit position and then move up to the upper limit, and a second control when the sheet is detected by the detection means, the second control for causing the pickup roller to move up by a second distance which is shorter than the first distance, the second distance is a distance where the pickup roller does not reach the upper limit position, by means of the driving mechanism during an initial operation to be performed prior to sheet feed request upon powering on or after paper jam elimination.

2. The sheet feeding device according to claim 1, wherein:

the driving mechanism includes a forwardly and backwardly rotatable motor and is configured to cause the pickup roller to move down toward the upper surface of the sheet support while rotating in a direction such as to feed the sheet by forward rotation of the motor and cause the pickup roller to move up in a direction away from the upper surface of the sheet support by backward rotation of the motor; and the control section is configured to control rotation of the motor during the initial operation.

3. The sheet feeding device according to claim 2, wherein the control section includes storage means configured to store therein information about whether or not the pickup roller is at the upper limit position based on a latest controlled state of the motor and is configured to perform the second control during the initial operation on condition that the sheet is detected by the detection means while information indicating that the pickup roller is not at the upper limit position is stored in the storage means.

4. The sheet feeding device according to claim 3, wherein the control section includes timer means configured to clock a predetermined time period from a point in time at which the sheet disappears from the sheet support and is configured to perform the first control during the initial operation after the timer means has clocked the predetermined time period.

5. The sheet feeding device according to claim 2, wherein the control section includes timer means configured to clock a predetermined time period from a point in time at which the sheet disappears from the sheet support and is configured to perform the first control during the initial operation after the timer means has clocked the predetermined time period.

6. The sheet feeding device according to claim 1, wherein the control section includes storage means configured to store therein information about whether or not the pickup roller is at the upper limit position based on a latest controlled state of the motor and is configured to perform the second control during the initial operation on condition that the sheet is detected by the detection means while information indicating that the pickup roller is not at the upper limit position is stored in the storage means.

7. The sheet feeding device according to claim 6, wherein the control section includes timer means configured to clock a predetermined time period from a point in time at which the sheet disappears from the sheet support and is configured to perform the first control during the initial operation after the timer means has clocked the predetermined time period.

8. The sheet feeding device according to claim 1, wherein the control section includes timer means configured to clock a predetermined time period from a point in time at which the sheet disappears from the sheet support and is configured to perform the first control during the initial operation after the timer means has clocked the predetermined time period.

9. A document reading device comprising: the sheet feeding device recited in claim 1; and an image reading section configured to read an image carried on a document fed from the sheet feeding device.

* * * * *